US007040913B2

(12) United States Patent
Parsadayan

(10) Patent No.: US 7,040,913 B2
(45) Date of Patent: May 9, 2006

(54) CONTROLLER MODULE POSITIONING AND ALIGNMENT FRAME

(75) Inventor: Walter Parsadayan, Lake Forest, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 942 days.

(21) Appl. No.: 09/846,439

(22) Filed: Apr. 25, 2001

(65) Prior Publication Data

US 2004/0029429 A1 Feb. 12, 2004

(51) Int. Cl.
*H01R 13/64* (2006.01)

(52) U.S. Cl. ..... 439/374; 439/532; 439/716; 439/353; 439/680

(58) Field of Classification Search ..... 439/532–535, 439/716–717, 353–355, 680, 374
See application file for complete search history.

(56) References Cited

U.S. PATENT DOCUMENTS 6,152,758 A * 11/2000 Matsuoka ..... 439/364
6,435,897 B1 * 8/2002 Paul et al. ..... 439/374

* cited by examiner

*Primary Examiner*—Truc Nguyen
(74) *Attorney, Agent, or Firm*—Fitch, Even, Tabin & Flannery

(57) ABSTRACT

The present invention relates to the field of security gate operating systems, more specifically a method and apparatus for attaching control module housings to a printed circuit board containing at least a portion of the controller for the security gate operating system. A controller module unit is disclosed with a plurality of controller module connectors of a first type mounted on a printed circuit; a controller module housing having a top wall, a bottom wall, a pair of opposing elongated walls and a pair or opposing shorter walls; a module housing second type of connector extending from the bottom wall may comprise an elongated second type connector body having a plurality of second type connector elements; the module housing second type connector body enters into a respective connector bay and enables connection between the first and second type connector elements.

44 Claims, 4 Drawing Sheets

CONTROLLER MODULE POSITIONING AND ALIGNMENT FRAME

FIELD OF THE INVENTION

The present invention relates to the field of security gate operating systems, and more specifically to a method and apparatus for attaching control module housings to a printed circuit board containing at least a portion of the controller for the security gate operating system.

BACKGROUND OF THE INVENTION

It is well known in the art of security gate controllers to have a printed circuit board on which to contain the controller, which may include such things as a microprocessor/microcontroller which can be programmed to perform a number of functions, as well as selectively positionable input/output switches utilized to customize the control of the security gate for a particular installation, e.g., setting alarm sensors, timers, operating frequencies and the like. These are most often done with switches and rheostats and the like that are fixedly attached to the printed circuit board containing the remainder of the security gate operating system controller, or substantially all of it. Certain elements, e.g., security gate loop controller modules may require, e.g., more complex customization for a given unit installation, e.g., setting the frequency at which a vehicle detection loop used by the system controller will operate, and the operating circuitry and components to operate the security gate vehicle detection unit. In such cases it may be necessary to have a module that is detachable from the printed circuit board and easily substituted for with a like module. In such cases, it is critical that the installer at the site of the security gate in question be able to correctly install the module. This can require correctly positioning the module with respect to connector pins or sockets on the printed circuit board with the corresponding socket or pins on the module, without damaging the pins or socket on the respective members, assuring that all pins are inserted into the appropriate socked on either the printed circuit board or the module, as appropriate, and retaining the module in connection on the circuit board, but allowing for subsequent removal and substitution in order to correct malfunctions or to change the desired operating characteristics of the security gate after initial installation. Since the modules can be rather substantial in size and heavy, misalignment in installation, in addition to perhaps improperly connecting each pin to its appropriate socket, may cause serious damage, as by bending one or more misaligned pins in the installation process.

There is, therefore a need for a better method and apparatus for the installation of controller modules onto a controller printed circuit board for a security gate controller.

SUMMARY OF THE INVENTION

A controller module unit is disclosed which may comprise a printed circuit board having a generally flat upper surface; a plurality of controller module connectors of a first type mounted on the printed circuit board, wherein each controller module connector may comprise: an elongated body; a plurality of first type connector elements arranged generally in alignment with the length of the elongated body; a flexible latching detent attached to the elongated body; a controller module alignment and positioning housing mounted on the printed circuit board; the controller module positioning and alignment frame may comprise: a front wall and a rear wall, each having an interior surface a connector bay containing a respective one of the controller module connectors; a first and a second guide shelf extending generally parallel to the upper surface of the printed circuit board, the separation of each of the first and second guide shelves from each other defining a first dimension of the connector bay; at least one guide wall extending vertically upward from each of the first and second guide shelves, the position of the at least one guide wall defining a second dimension of the connector bay for the respective connector; a controller module, that may comprise: a controller module housing having a top wall, a bottom wall and a pair of opposing elongated walls and a pair or opposing shorter walls, and a module housing second type of connector extending from the bottom wall, the module housing second type connector that may comprise: an elongated second type connector body having a plurality of second type connector elements arranged generally in alignment with the length of elongated connector body; an elongated generally rigid latching member extending along one side of the elongated second type connector body; with the first and second guide shelves positioned with respect to the connector bay and the respective first type connector element positioned with respect to the connector bay and the second type connector positioned with respect to the bottom wall of the module housing such that when a first one of the pair of shorter walls of the module housing is in contact with the interior surface of one of the front and rear walls of the positioning and alignment frame, the module housing second type connector body comes into contact with one of the first and second shelves and when the second one of the pair of shorter walls of the module housing is in contact with the interior surface of the other of the front and rear walls of the positioning and alignment frame, the module housing second type connector body enters into the respective connector bay and enables connection between the first and second type connector elements.

DETAILED DESCRIPTION OF THE PREFERRED EMBODIMENTS

Figure 1:
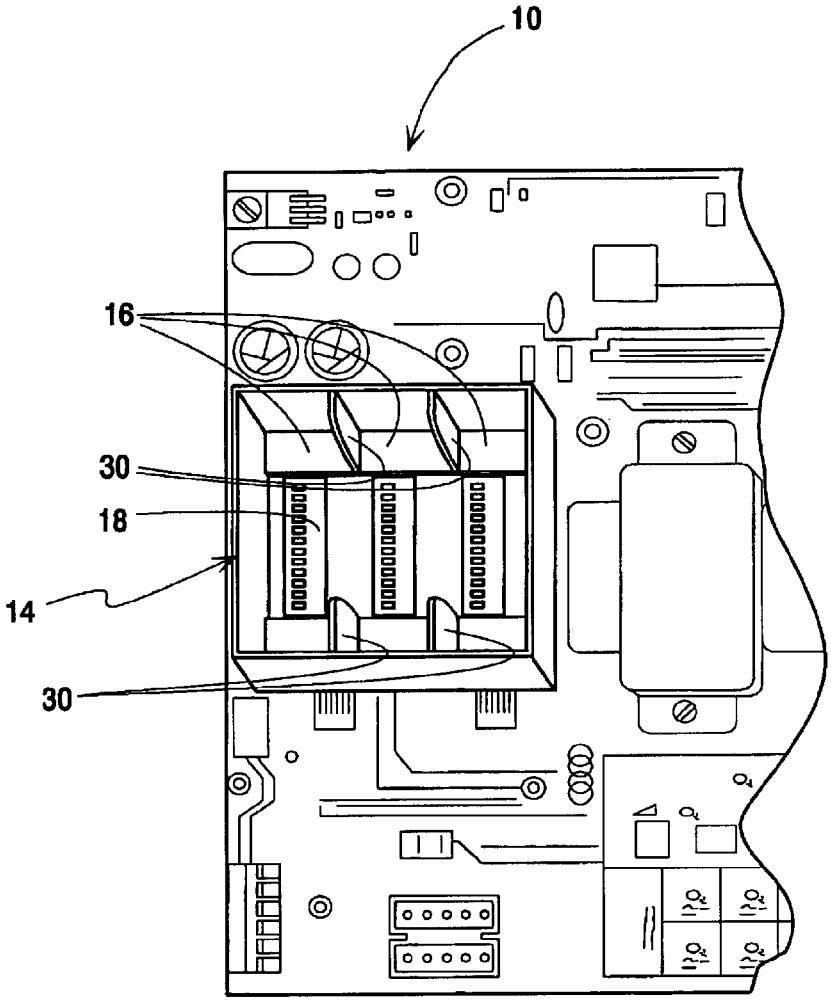
FIG. 1 shows a top perspective view of a printed circuit board containing a portion of the controller for a security ate operating system.

Turning now to FIG. 1 there is shown a portion of a security gate operating mechanism controller 10, having a printed circuit board 12 shown in a partially cutaway plan view. Mounted on the printed circuit board 12, as by being attached by screws (not shown), is an alignment and positioning receptor 14, as more fully described below. The alignment and positioning receptor 14 can have a pair of receptor shelves 16 and a receptor well 18, with each of the receptor shelves 16 being separated into several, e.g., three, separate receptor slots by guide walls 30. Positioned within the receptor well 18, aligned with each respective receptor slot is a connector element 80, which as shown may be a male connector element 80, as more fully described below. It will be understood by those skilled in the art that this could also be a female connector element 80, without departing from the concept of the invention.

Figure 2:
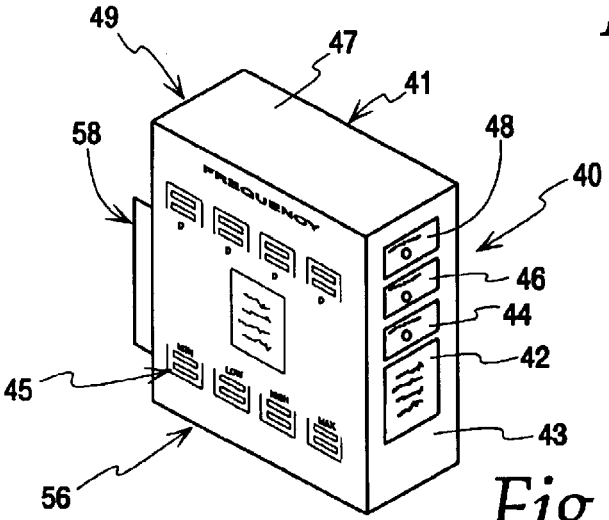
FIG. 2 shows a detachable controller module housing to be mounted on the circuit board, and positioned within an alignment and positioning receptor according to the present invention.

Turning now to FIG. 2, there is shown a security gate operating system controller module 40. The controller module can be, e.g., a module containing circuitry and electronic/electro-mechanical/electro-magnetic components that are associated with, e.g., a sensor loop, which may be utilized to sense the various positions of a vehicle as it passes through the security gate in relation to the steps of operating the gate in the open or closed direction as the vehicle passes through the gate. It is often desirable to have several different such loops and to operate each with a separate controller, which may also have some slightly different operating parameter(s), e.g., the operating frequency of the sensor apparatus. These parameters may vary from installation to installation, and may, therefore, be most conveniently incorporated into the security gate operating system controller by selective installation of customizable modules. The controller module 40 may have a casing 41 which may comprise a top wall 43, a pair of opposing elongated side walls 45 and a pair of shortened opposing side walls 47, as well as a bottom wall 49. The top wall 43 may contain switches 42, e.g., for selecting a parameter, e.g., operating frequency, and indicator lights for, e.g., "loop fail" 46, "detect" in effect 44 and "power on" 48. At least one of the elongated side walls 45 may contain text 56 with instructions, e.g., for setting up the module 40 to obtain the desired parameter(s). Extending from the bottom wall 49 can be a connector element 58, as more fully described below, which as illustrated can be a female connector element 58. It will be understood by those skilled in the art that the connector element 58 can be a male connector element 58, provided that the connector element 80 is also modified to be a female connector element 80 without departing from the concept of the present invention.

Figure 4:
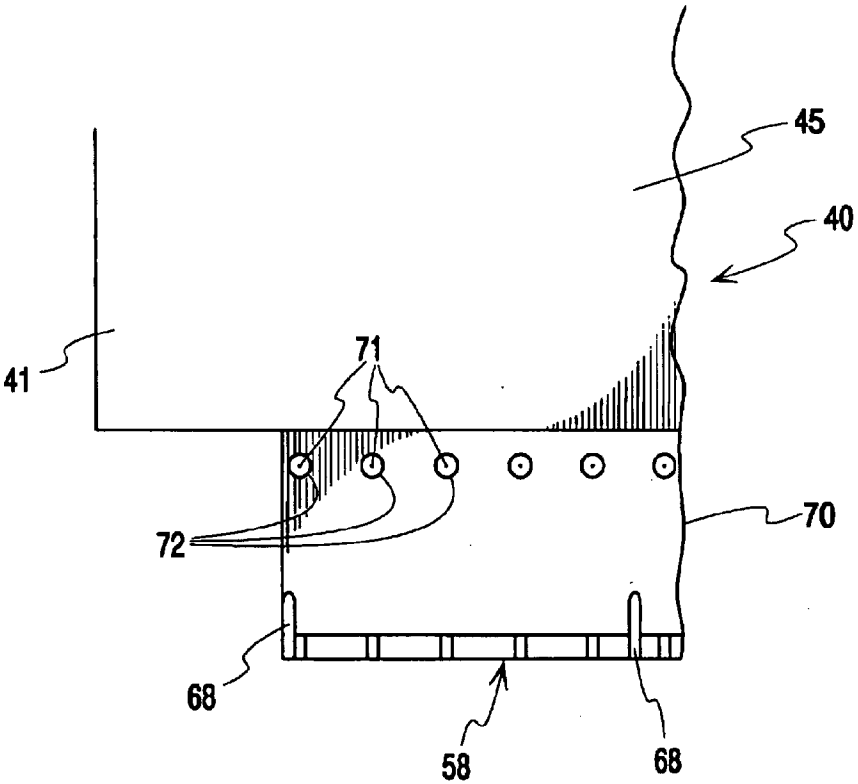
FIG. 4 shows a front view of the controller module of FIG. 3.
Figure 3:
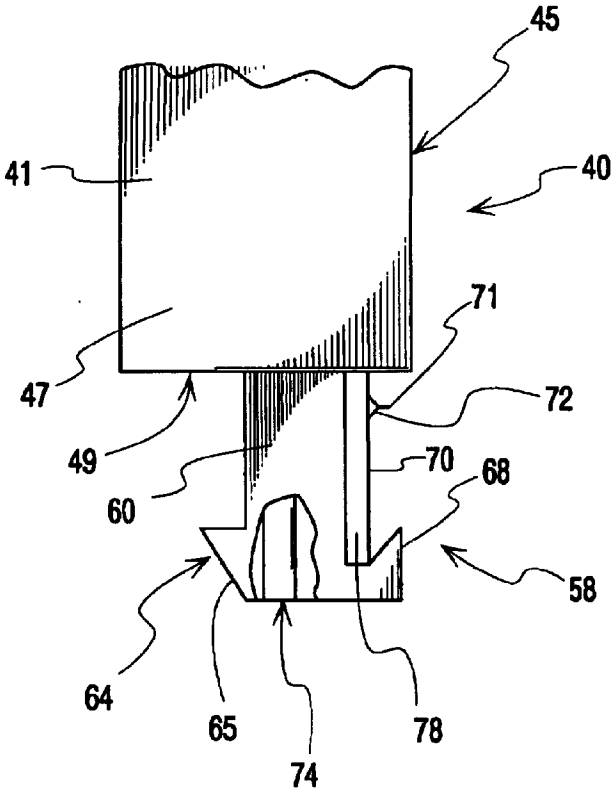
FIG. 3 shows a side view of the bottom of a controller module with an aligning connector member at the bottom the module.

Turning now to FIG. 3 and FIG. 4, there is shown respectively, a side view and a front view, of the security gate operating mechanism controller module 40, with part of the casing 41 of the module 40 cut off The casing 41 may have extending from the bottom wall 49 thereof a connector element 58. The connector element 58 may include a connector body 60 extending outwardly from the bottom wall 49 and including a connector setting flange 64, which may extend along the length of the connector body 60. On the opposing side of the connector body 60 there can be an attachment for a portion of a controller module printed circuit 70, extending out from an opening in the bottom wall 49 of the casing 41. This attachment may comprise, e.g., a plurality of soldered connections 71 of wires 72, which can each extend into the connector body 60 for attachment to a respective one of a plurality of female connector receptacles 74, one of such female connector receptacles 74 being shown through the partial cut-away view into the connector body 60. The connector body 60 on the elongated side opposing the setting flange 64 including the attachment of the printed circuit board 70 may also include a plurality of protrusions 68 extending upwardly from a shelf 78, the upper surface of which may abut the printed circuit board 70 and the protrusions 60 on the interior side thereof may serve to hold the printed circuit board 70 in place and on the exterior side thereof may serve to aide in properly inserting the module 40 into the appropriate receptor slot.

Figure 6:
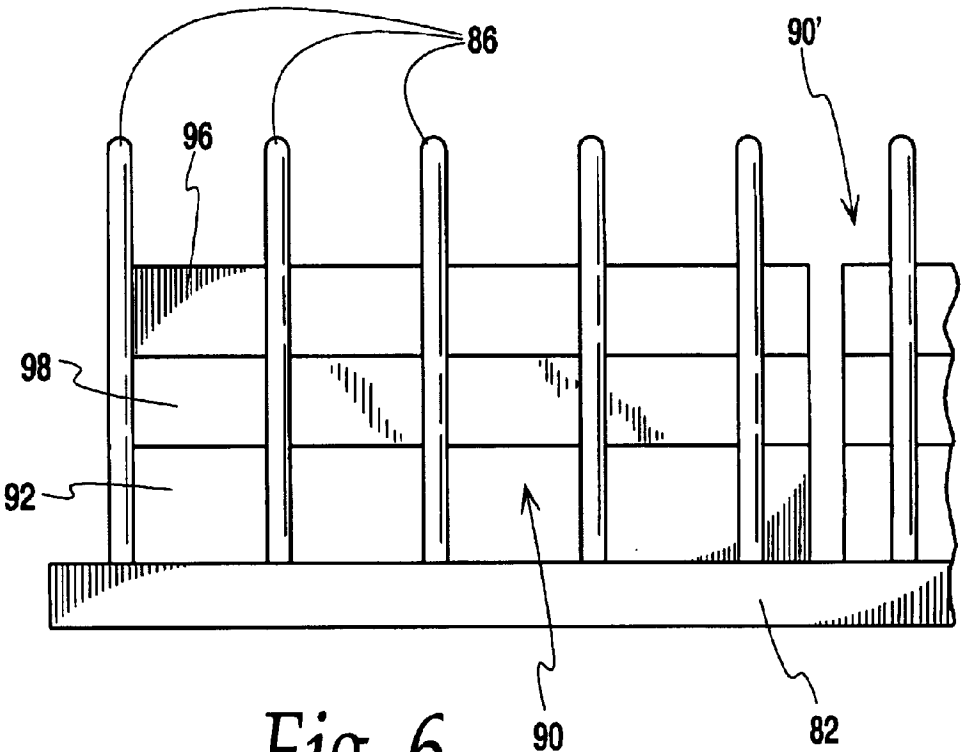
FIG. 6 shows a front view of the connector pin mounting of FIG. 5.

Turning now to FIG. 6 there is shown a front view of the connector as shown in FIG. 3.

Figure 5:
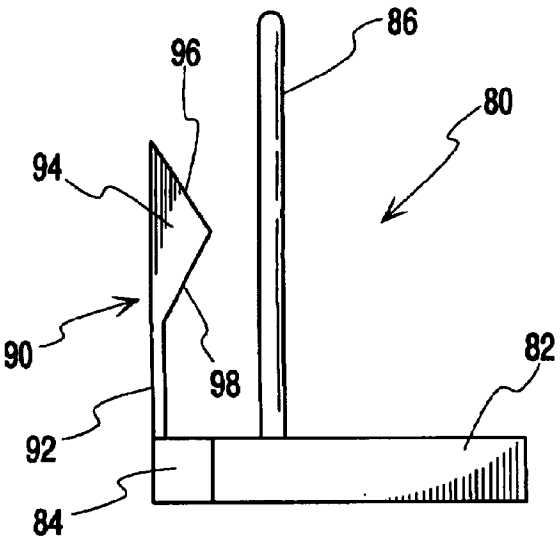
FIG. 5 shows a side view of a connector pin mounting according to the present invention.

Turning now to FIG. 5 and FIG. 6, there is shown a side view of the connector element 80, which can be attached to the floor of the receptor well 18 as for example, by a combination of the solder connection (not shown) of its pins 86 to the underside surface of the printed circuit board 12 and adhesive attachment of a base member 82 of the connector element 80 to the upper side surface of the printed circuit board 12 in the receptor well 18. The connector element 80 may have a plurality of male connector pins 86, for example ten such pins 88 spaced generally evenly along the length of the connector element 80. The base member 82 may have a notch 84 removed from opposing comers of the base member 82 on the side to which a detent member 90 is attached to the base member 82. In addition, the connector element 80 may have a spring-loaded detent member 90. The spring loaded detent portion 90 may comprise a flexible side wall portion 92 and a detent member 94 at the distal end of the flexible wall portion 92, which may comprise an upper inwardly slanting surface 96 and a lower inwardly slanting surface 98 which intersects the upper inwardly slanting surface 96. As shown in FIG. 6, the detent member 90 may comprise a second detent member 90', with each of the detent member 90 and the second detent member 90' extending substantially along the entire length of the base member 82 of connector element 80.

The connector element 58 connector body 60 and the connector element 80 base member 82 and detent member 90 may each be constructed as is well known from s suitable plastic by molding or extrusion and subsequent trimming, to form e.g., the notches 84.

Figure 7:
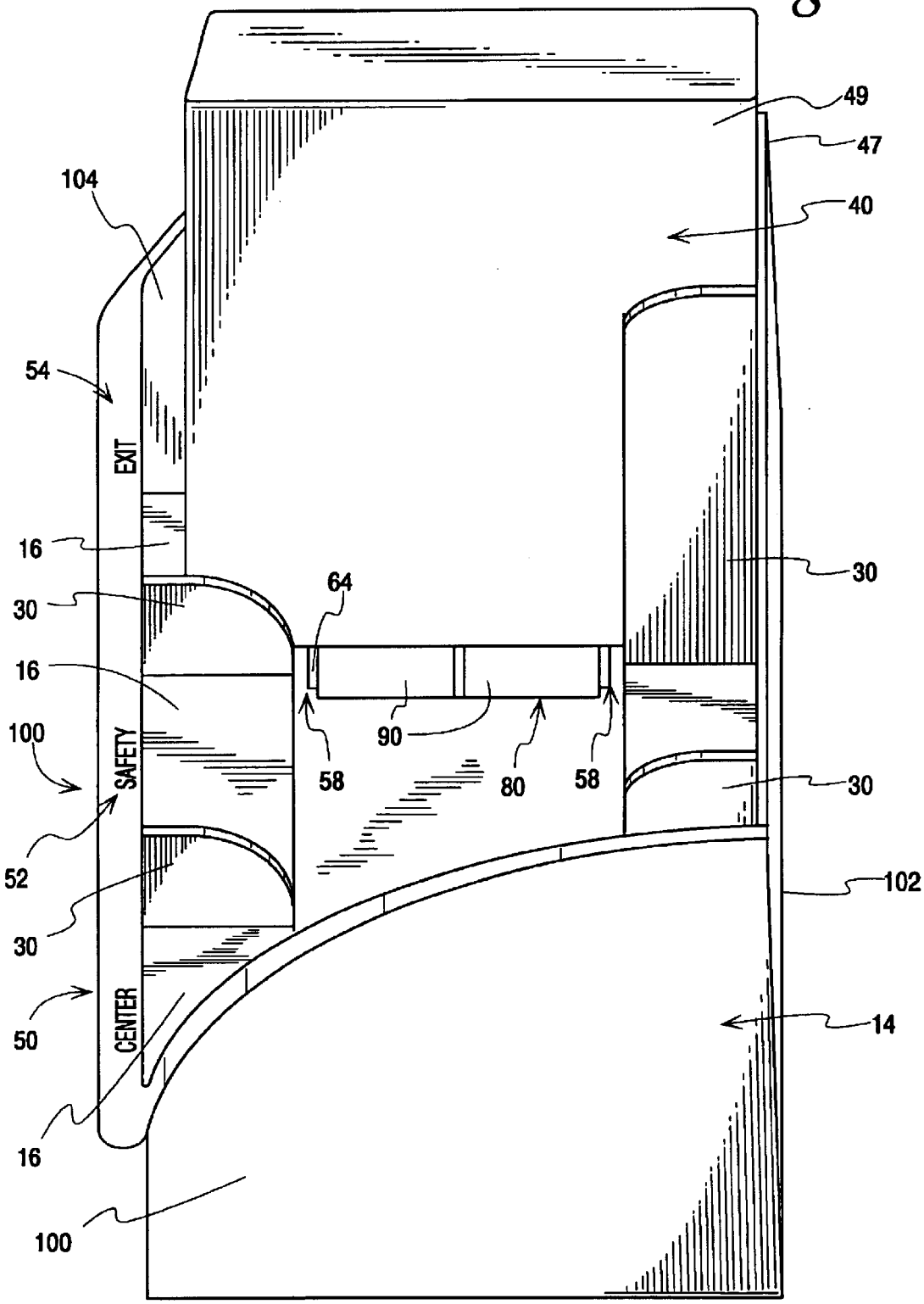
FIG. 7 shows a perspective view of an alignment and positioning receptor according to the present invention.

Turning now to FIG. 7 there is shown a perspective side view of the positioning and alignment receptor 14 with a controller module 40 inserted into a respective receptor slot. As shown, the controller module 40 bottom wall 49 may abut the respective portion of the shelf 16 within the respective receptor slot and the connector element 58 is receivedly engaged by the connector element 80, with the setting flange engaged by the detents 94 (not shown in FIG. 7) on the flexible detent members 90 and 90'. The alignment and positioning receptor 14 as shown may have a side wall 100, a back wall 102, a second side wall 104 and a front wall 106. As shown, the front wall 106 may be shorter in elevation than the back wall 102 and may have a plurality of module locator texts 50, 52 and 54 one for each respective receptor slot for each respective module 40 indicating which respective type of module belongs in the respective receptor slot. The connector element 80 is positioned within the respective receptor slot portion of the receptor well 18 such that with one wall of the module 40, e.g., the shortened side wall 47 of the module 40 generally abutting the rear wall 102 of the positioning and alignment receptor the connector element 58 and the connector element 80 are in alignment to properly engage, e.g., the pins on the connector element 80 with the receptacle 74 on the connector element 58, with each such pin 86 aligned with its respective receptacle 74. In the event that the connector element 58 is misaligned to the left as shown in FIG. 7, the connector element 58 will be prevented from being inserted into the respective receptor slot portion of the receptor well, as, e.g., by the connector element 58 engaging the shelf portion 16 in the respective receptor slot, e.g., to the left of the module as positioned as shown in FIG. 7. In addition, with the connector element 58 positioned on the module to be displaced from the centerline of the bottom wall 49, as shown in FIG. 3, any attempt to insert the module backwards, e.g., with shortened side wall 47 on the left hand side of the view as shown in FIG. 7 will result in the connector element 58 being prevented from being inserted into the respective receptor slot portion of the receptor well 18, as, for example, by the connector element 58 engaging the top of the flexible detent element 90 in a manner that will not induce the detent member to flex to give way for the insertion of the connector element 58, as occurs, e.g., when the module 40 is inserted in the proper alignment and positioning such that the setting flange is properly aligned such that, e.g., its slanted portion 65 engages the top inwardly slanting surface of the flexible detent member 90 and flexes the detent member 90 to allow engagement of the setting flange 64 by the detent member 90 when it bends back into the upright position.

In operation, therefore, the present invention may be utilized to insure, e.g., that the module 40 and its connector element 58 are properly inserted so as to insure correct connector contact between the respective male and female elements, e.g., pins 86 and receptacles 74, and that the installer cannot attempt to force a connection with a misalignment/mispositioning of the module, causing damage to either of the male or female connector elements 58, 80, and particularly, e.g., bent pins 86.

While the preferred embodiments of the present invention have been shown and described, it will be apparent to those skilled in the art that various modifications may be made in these embodiments without departing from the spirit of the present invention. For that reason, the scope of the invention is set forth in the following claims:

I claim:

1. A controller module unit, comprising:

a printed circuit board having an upper surface;

a plurality of controller module connectors of a first type mounted on the printed circuit board, each controller module first type connector comprising:

an elongated body;

a plurality of first type connector elements arranged generally in alignment with the length of the elongated body;

a flexible latching detent attached to the elongated body;

a controller module, comprising:

a controller module housing having a top wall, a bottom wall and a pair of opposing elongated side walls and a pair or opposing shorter side walls, and a module connector element of a second type extending from the bottom wall, the module housing second type connector comprising:

an elongated second type connector body having a plurality of second type connector elements arranged generally in alignment with the length of the elongated connector body;

an elongated generally rigid latching member extending along one side of the elongated second type connector body;

a controller module alignment and positioning frame mounted on the printed circuit board;

the controller module positioning and alignment frame comprising:

a front wall and a rear wall, each having an interior surface a connector bay containing a respective one of the controller module first type connectors;

a first and a second guide shelf extending generally parallel to the upper surface of the printed circuit board, the separation of each of the first and second guide shelves from each other defining a first dimension of the connector bay;

at least one guide wall extending vertically upward from each of the first and second guide shelves, the position of the at least one guide wall defining a second dimension of the connector bay for the respective module first type connector;

wherein the first and second guide shelves are positioned with respect to the respective connector bay and the respective first type connector element is positioned with respect to the connector bay and the second type connector element is positioned with respect to the bottom wall of the module housing such that when a first one of the pair of shorter walls of the module housing is in contact with the interior surface of one of the front and rear walls of the positioning and alignment frame, the module housing second type connector body comes into contact with one of the first and second shelves and when the second one of the pair of shorter walls of the module housing is in contact with the interior surface of the other of the front and rear walls of the positioning and alignment frame, the module housing second type connector body enters into the respective connector bay and enables connection between the first and second type connector elements.

2. The apparatus of claim 1 wherein when the first of the pair of shorter walls is in contact with the interior surface of the other of the front and rear walls of the positioning and alignment frame, the body of the module second type connector is prevented from entering the respective receptor bay by engaging the body of the module second type connector.

3. The apparatus of claim 1 in which the first type connector is a male type connector having a plurality of pins and the second type connector is a female connector having a plurality of pin receptacles.

4. The apparatus of claim 1 in which the second type connector is a male type connector having a plurality of pins and the first type connector is a female connector having a plurality of pin receptacles.

5. The apparatus of claim 2 in which the first type connector is a male type connector having a plurality of pins and the second type connector is a female connector having a plurality of pin receptacles.

6. The apparatus of claim 2 in which the second type connector is a male type connector having a plurality of pins and the first type connector is a female connector having a plurality of pin receptacles.

7. The apparatus of claim 1 wherein the bottom wall of the controller module housing has a centerline along its length and the plurality of second type connector elements are aligned displaced from the centerline.

8. The apparatus of claim 2 wherein the bottom wall of the controller module housing has a centerline along its length and the plurality of female connector receptacles are aligned displaced from the centerline.

9. The apparatus of claim 3 wherein the bottom wall of the controller module housing has a centerline along its length and the plurality of male connector pins are aligned displaced from the centerline.

10. The apparatus of claim 4 wherein the bottom wall of the controller module housing has a centerline along its length and the plurality of second type connector elements are aligned displaced from the centerline.

11. The apparatus of claim 5 wherein the bottom wall of the controller module housing has a centerline along its length and the plurality of female connector receptacles are aligned displaced from the centerline.

12. The apparatus of claim 6 wherein the bottom wall of the controller module housing has a centerline along its length and the plurality of male connector pins are aligned displaced from the centerline.

13. The apparatus of claim 3 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

14. The apparatus of claim 4 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

15. The apparatus of claim 5 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

16. The apparatus of claim 6 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

17. The apparatus of claim 7 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

18. The apparatus of claim 8 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

19. The apparatus of claim 9 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

20. The apparatus of claim 10 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

21. The apparatus of claim 11 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

22. The apparatus of claim 12 wherein the flexible latching detent comprises:

a generally vertical wall having an upper end and a lower end, with an upper slanted detent surface protruding from one side of the generally vertical wall and a lower slanted detent surface protruding from the same side of the generally vertical wall and intersecting the upper slanted surface.

23. A controller module unit, comprising:

a printed circuit board having an upper surface;

a plurality of controller module connectors of a first type mounted on the printed circuit board, each controller module first type connector comprising:

an elongated body;

a plurality of first type connector elements arranged generally in alignment with the length of the elongated body;

a latching means attached to the elongated body;

a controller module, comprising:

a controller module housing having a controller module connector element of a second type extending from the controller module housing, the controller module second type connector comprising:

an elongated second type connector body having a plurality of second type connector elements arranged generally in alignment with the length of the elongated connector body;

a latching means for, in cooperation with the latching means on the controller module first type connector, holding the controller module first type connector and second type connector in a mated position;

a controller module alignment and positioning means mounted on the printed circuit board;

the controller module positioning and alignment means comprising:

a connector bay containing a respective one of the controller module first type connectors;

guide means for positioning the controller module second type connector element with respect to the controller module first type connector element, including a guide shelf and at least one guide wall extending vertically upward from the guide shelf, for preventing the second type connector element from entering the receptor bay unless the first type connector element and the second type connector element are properly aligned and positioned to engage in the mated position.

24. The apparatus of claim 23 in which the first type connector is a male type connector having a plurality of pins and the second type connector is a female connector having a plurality of pin receptacles.

25. The apparatus of claim 23 in which the second type connector is a male type connector having a plurality of pins and the first type connector is a female connector having a plurality of pin receptacles.

26. The apparatus of claim 23 wherein first type connector element and the second type connector element are positioned with respect to the controller module housing and the receptor bay so as to prevent entry of the controller module second type connector element into the receptor bay if the first type connector element and second type connector element are not properly aligned and positioned to ally the first type connector element and the second type connector element to engage in the mate position.

27. The apparatus of claim 26 in which the first type connector is a male type connector having a plurality of pins and the second type connector is a female connector having a plurality of pin receptacles.

28. The apparatus of claim 26 in which the second type connector is a male type connector having a plurality of pins and the first type connector is a female connector having a plurality of pin receptacles.

29. The apparatus of claim 23 wherein the controller module housing has a centerline along its length and the plurality of second type connector elements are aligned displaced from the centerline.

30. The apparatus of claim 26 wherein the controller module housing has a centerline along its length and the plurality of female connector receptacles are aligned displaced from the centerline.

31. The apparatus of claim 24 wherein the controller module housing has a centerline along its length and the plurality of male connector pins are aligned displaced from the centerline.

32. The apparatus of claim 25 wherein controller module housing has a centerline along its length and the plurality of second type connector elements are aligned displaced from the centerline.

33. The apparatus of claim 27 wherein the controller module housing has a centerline along its length and the plurality of female connector receptacles are aligned displaced from the centerline.

34. The apparatus of claim 28 wherein the controller module housing has a centerline along its length and the plurality of male connector pins are aligned displaced from the centerline.

35. The apparatus of claim 24 wherein the controller module first type connector latching means comprises:

a generally vertical flexible wall with a detent means contained on the generally vertical wall.

36. The apparatus of claim 25 wherein the controller module first type connector latching means comprises:

a generally vertical flexible wall with a detent means contained on the generally vertical wall.

37. The apparatus of claim 27 wherein the controller module first type connector latching means comprises:

a generally vertical flexible wall with a detent means contained on the generally vertical wall.

38. The apparatus of claim 28 wherein the controller module first type connector latching means comprises:

a generally vertical flexible wall with a detent means contained on the generally vertical wall.

39. The apparatus of claim 29 wherein the controller module first type connector latching means comprises:

a generally vertical flexible wall with a detent means contained on the generally vertical wall.

40. The apparatus of claim 30 wherein the controller module first type connector latching means comprises:

a generally vertical flexible wall with a detent means contained on the generally vertical wall.

41. The apparatus of claim 31 wherein the controller module first type connector latching means comprises:

a generally vertical flexible wall with a detent means contained on the generally vertical wall.

42. The apparatus of claim 21 wherein the controller module first type connector latching means comprises:

a generally vertical flexible wall with a detent means contained on the generally vertical wall.

43. The apparatus of claim 22 wherein the controller module first type connector latching means comprises:

a generally vertical flexible wall with a detent means contained on the generally vertical wall.

44. The apparatus of claim 23 wherein the controller module first type connector latching means comprises:

a generally vertical flexible wall with a detent means contained on the generally vertical wall.

* * * * *

UNITED STATES PATENT AND TRADEMARK OFFICE

CERTIFICATE OF CORRECTION

PATENT NO. : 7,040,913 B2
APPLICATION NO. : 09/846439
DATED : September 15, 2006
INVENTOR(S) : Walter Parasadayan It is certified that error appears in the above-identified patent and that said Letters Patent is hereby corrected as shown below:

IN THE CLAIMS:

Claim 1, Column 5, line 48, delete "or" and insert -- of --.

Signed and Sealed this

Twenty-seventh Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 7,040,913 B2
APPLICATION NO. : 09/846439
DATED : May 9, 2006
INVENTOR(S) : Walter Parasadayan It is certified that error appears in the above-identified patent and that said Letters Patent is hereby corrected as shown below:

IN THE CLAIMS:

Claim 1, Column 5, line 48, delete "or" and insert -- of --.

This certificate supersedes Certificate of Correction issued February 27, 2007.

Signed and Sealed this

Twentieth Day of March, 2007

JON W. DUDAS
*Director of the United States Patent and Trademark Office*